US011081071B2

(12) United States Patent
Koudo

(10) Patent No.: US 11,081,071 B2
(45) Date of Patent: Aug. 3, 2021

(54) LIQUID CRYSTAL DISPLAY DEVICE AND VIDEO SIGNAL PROCESSING METHOD

(71) Applicants: Panasonic Liquid Crystal Display Co., Ltd., Himeji (JP); Pasona Knowledge Partner Inc., Osaka (JP)

(72) Inventor: Toshikazu Koudo, Hyogo (JP)

(73) Assignees: PANASONIC LIQUID CRYSTAL DISPLAY CO., LTD., Hyogo (JP); PASONA KNOWLEDGE PARTNER INC., Osaka (JP)

( * ) Notice: Subject to any disclaimer, the term of this patent is extended or adjusted under 35 U.S.C. 154(b) by 0 days.

(21) Appl. No.: 16/709,570

(22) Filed: Dec. 10, 2019

(65) Prior Publication Data

US 2020/0193926 A1 Jun. 18, 2020

(30) Foreign Application Priority Data

Dec. 14, 2018 (JP) ..... JP2018-234499

(51) Int. Cl.
*G09G 3/36* (2006.01)

(52) U.S. Cl.
CPC ... *G09G 3/3648* (2013.01); *G09G 2320/0276* (2013.01)

(58) Field of Classification Search
CPC ..... G09G 3/3607; G09G 2320/0276; G09G 2320/0285; G09G 3/2092; G09G 2300/023; G09G 3/3648; G09G 3/003; G09G 2320/0209; G09G 2320/0257; G09G 2320/0261; G09G 2320/0266; G09G 2320/0271
See application file for complete search history.

(56) References Cited

U.S. PATENT DOCUMENTS 5,315,377 A 5/1994 Isono et al.
2009/0147186 A1 6/2009 Nakai et al.
(Continued)

FOREIGN PATENT DOCUMENTS

JP 5-122733 5/1993
JP 2017-076064 4/2017
(Continued)

OTHER PUBLICATIONS

Office Action issued for the related U.S. Appl. No. 16/709,523, dated Oct. 7, 2020, 12 pages.
(Continued)

*Primary Examiner* — Adam R. Giesy
(74) *Attorney, Agent, or Firm* — Hamre, Schumann, Mueller & Larson, P.C.

(57) ABSTRACT

A liquid crystal display device that displays an input video signal, the liquid crystal display device comprising: a first liquid crystal display panel and a second liquid crystal display panel disposed to be laminated; a gamma corrector that generates a corrected video signal by performing gamma correction decided depending on a first control signal input from an outside with respect to the video signal; a first video signal generator that generates a first video signal for the first liquid crystal display panel using the corrected video signal; and a second video signal generator that generates a second video signal for the second liquid crystal display panel using the first video signal.

8 Claims, 12 Drawing Sheets

(56) References Cited

U.S. PATENT DOCUMENTS

| | | | | |
|---|---|---|---|---|
| 2012/0092468 | A1* | 4/2012 | Okamoto | H04N 13/317 348/55 |
| 2013/0038811 | A1* | 2/2013 | Sugita | G02F 1/1337 349/61 |

FOREIGN PATENT DOCUMENTS

| | | |
|---|---|---|
| JP | 2018-54679 | 4/2018 |
| JP | 2019-090886 | 6/2019 |
| WO | 2007/040127 | 4/2007 |

OTHER PUBLICATIONS

Office Action issued for the related Japanese Patent Application No. 2018-234499, dated Dec. 1, 2020, 9 pages including machine translation.

Office Action issued for the corresponding Japanese patent application No. 2018-233302, dated Jan. 5, 2021, 10 pages including machine translation.

* cited by examiner

LIQUID CRYSTAL DISPLAY DEVICE AND VIDEO SIGNAL PROCESSING METHOD

CROSS-REFERENCE TO RELATED APPLICATION

This application claims priority from Japanese application JP 2018-234499, filed Dec. 14, 2018. This Japanese application is incorporated herein by reference.

BACKGROUND

1. Technical Field

The present disclosure relates to a liquid crystal display device and a video signal processing method performed by the liquid crystal display device, more particularly to a liquid crystal display device including two liquid crystal display panels disposed to be laminated.

2. Description of the Related Art

In the liquid crystal display device, there has been proposed a technique of performing stereoscopic (3D) display (see Unexamined Japanese Patent Publication No. H5-122733) and a technique of improving contrast (see International Publication No. WO2007/040127) by disposing two liquid crystal display panels to be laminated (that is, stacked).

The former expresses a depth using two liquid crystal display panels, and takes advantage of a stereoscopically visible image due to parallax. On the other hand, the latter enhances expressive power of black using the fact that total transmittance of the two liquid crystal display panels is decided by multiplying the respective transmittances. That is, in the latter, the stereoscopic vision due to the parallax is prevented as much as possible.

SUMMARY

In a medical field, there is a demand for high contrast in displaying medical images such as an X-ray photograph. That is, in the display of the medical image, there is a demand for a liquid crystal display panel that performs a high-luminance dynamic range two-dimensional (2D) display with high definition and high sharpness from a dark portion to a bright portion. On the other hand, in the details of the medical image, there is also demand for stereoscopic expressive power that can instantly discriminate between a vein and an artery by stereoscopic viewing of a blood vessel and identify an anteroposterior relation of an organ.

Conventionally, although the 2D display and the 3D display can be switched in response to the demand for mixing the high-contrast 2D display and the 3D display, the display characteristics of the 2D display and the 3D display cannot be mixed with a desired ratio (that is, a mixing ratio is changed seamlessly and linearly). For this reason, even if a user wants to mix and view degrees of the high-contrast 2D display and the 3D display with the desired ratio, the degrees of the high-contrast 2D display and the 3D display cannot be mixed with the desired ratio and viewed depending on a type of the medical image or an observation region, which results in a problem in that smooth diagnosis is obstructed because the user views the medical image by switching the medical image only to either the high-contrast 2D display or the 3D display.

SUMMARY

The present disclosure has been made in view of the above problems, and an object of the present disclosure is to provide a liquid crystal display device and a video signal processing method suitable for seamlessly and linearly changing the mixing ratio of the high-contrast 2D display and 3D display.

Solution to Problem

To solve the above problem, a liquid crystal display device that displays an input video signal according to a present disclosure comprises: a first liquid crystal display panel and a second liquid crystal display panel disposed to be laminated; a gamma corrector that generates a corrected video signal by performing gamma correction decided depending on a first control signal input from an outside with respect to the video signal; a first video signal generator that generates a first video signal for the first liquid crystal display panel using the corrected video signal; and a second video signal generator that generates a second video signal for the second liquid crystal display panel using the first video signal.

To solve the above problem, a video signal processing method performed by a liquid crystal display device including a first liquid crystal display panel and a second liquid crystal display panel disposed to be laminated, the video signal processing method according to a present disclosure comprises: a gamma correction step of generating a corrected video signal by performing gamma correction decided depending on a first control signal input from the outside with respect to an input video signal; a first video signal generation step of generating a first video signal for the first liquid crystal display panel using the corrected video signal; and a second video signal generating step of generating a second video signal for the second liquid crystal display panel using the first video signal.

The liquid crystal display device according to the present disclosure can provide a liquid crystal display device and a video signal processing method suitable for seamlessly and linearly changing the mixing ratio of the high-contrast 2D display and 3D display.

Figure 1:
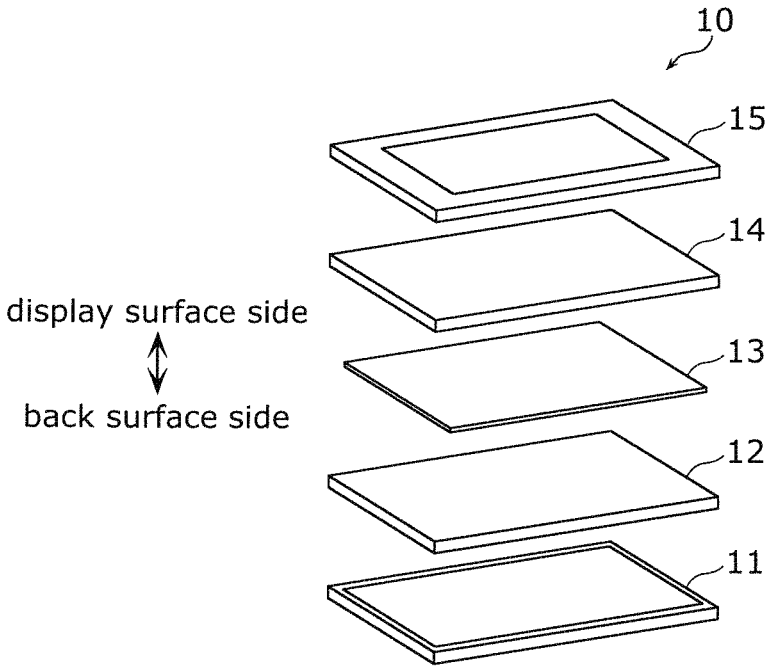
FIG. 1 is a perspective view illustrating a configuration of liquid crystal display device according to an exemplary embodiment.

Hereinafter, exemplary embodiments of the present disclosure will be described with reference to drawings. The following exemplary embodiments illustrate a preferable specific example of the present disclosure. Thus, numerical values, shapes, materials, constituent elements, arrangement positions and connection forms of the constituent components, and the like illustrated in the following exemplary embodiments are merely examples, and are not intended to limit the present disclosure. Among the constituent elements in the following exemplary embodiments, the constituent elements not described in independent claims indicating the broadest concept of the present disclosure are described as optional constituent elements. The drawings are schematic diagrams, and not necessarily strictly illustrated. In the drawings, substantially the same configuration is designated by the same reference numerals, and overlapping description will be omitted or simplified.

FIG. 1 is a perspective view illustrating a configuration of liquid crystal display device 10 according to an exemplary embodiment. Liquid crystal display device 10 includes backlight 11, first liquid crystal display panel 12, adhesive layer 13 bonding first liquid crystal display panel 12 and second liquid crystal display panel 14, second liquid crystal display panel 14, and front chassis 15 covering first liquid crystal display panel 12 and second liquid crystal display panel 14 from the display surface side, which are disposed from a back surface side toward a display surface side. In the exemplary embodiment, the following explanation is given on an assumption that first liquid crystal display panel 12 located on the back surface side is a black-and-white (that is, gray scale) display panel, and that the second liquid crystal display panel 14 located on the display surface side is a color display panel. The configuration of liquid crystal display device 10 is not limited to this combination, but each of first liquid crystal display panel 12 and second liquid crystal display panel 14 may independently be any one of the black-and-white display panel and the color display panel.

Figure 2:
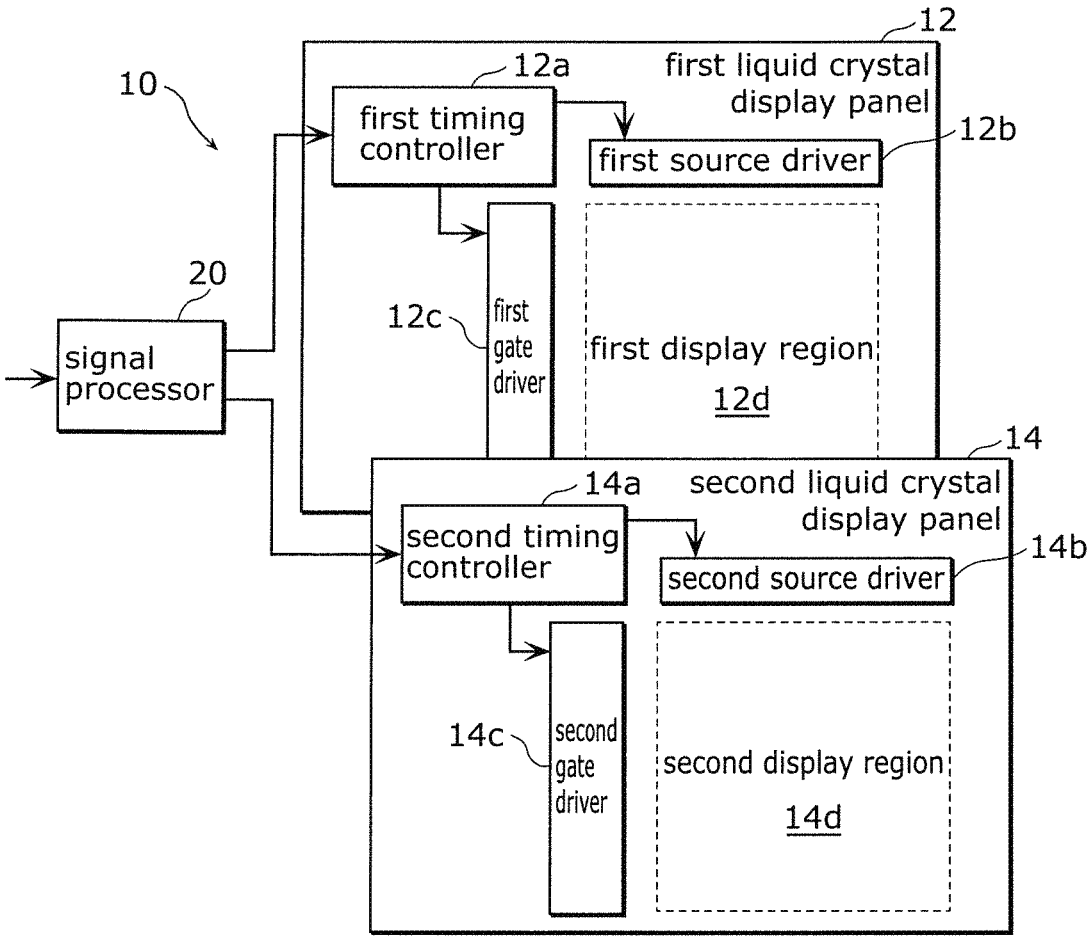
FIG. 2 is a view illustrating a configuration relating to signal processing of liquid crystal display device in FIG. 1.

FIG. 2 is a view illustrating a configuration relating to signal processing of liquid crystal display device 10 in FIG. 1. Liquid crystal display device 10 includes signal processor 20, first liquid crystal display panel 12, and second liquid crystal display panel 14 as a configuration relating to the signal processing.

Signal processor 20 performs processing of seamlessly and linearly changing the mixing ratio of each of the high-contrast 2D display and 3D display with respect to an input video signal, generates a first video signal for first liquid crystal display panel 12 and a second video signal for the second liquid crystal display panel 14, and outputs the first video signal and the second video signal to first liquid crystal display panel 12 and second liquid crystal display panel 14. As used herein, video includes not only moving images but also still images such as a medical image.

First liquid crystal display panel 12 is a panel (in the exemplary embodiment, the black-and-white display panel) that displays the first video signal output from signal processor 20. First liquid crystal display panel 12 includes first timing controller 12*a* that generates the video signal and a synchronizing signal from the input first video signal, first source driver 12*b* that displays and drives first display region 12*d* according to the video signal generated by first timing controller 12*a*, first gate driver 12*c* that performs display control of first display region 12*d* in units of rows according to the synchronizing signal generated by first timing controller 12*a*, and first display region 12*d* constructed with pixels arranged two-dimensionally.

Second liquid crystal display panel 14 is a panel (in the exemplary embodiment, the color display panel) that displays the second video signal output from signal processor 20. Second liquid crystal display panel 14 includes second timing controller 14*a* that generates the video signal and the synchronizing signal from the input second video signal, second source driver 14*b* that displays and drives second display region 14*d* according to the video signal generated by second timing controller 14*a*, second gate driver 14*c* that performs display control of the second display region 14*d* in units of rows according to the synchronizing signal generated by second timing controller 14*a*, and second display region 14*d* constructed with pixels arranged two-dimensionally.

Figure 3:
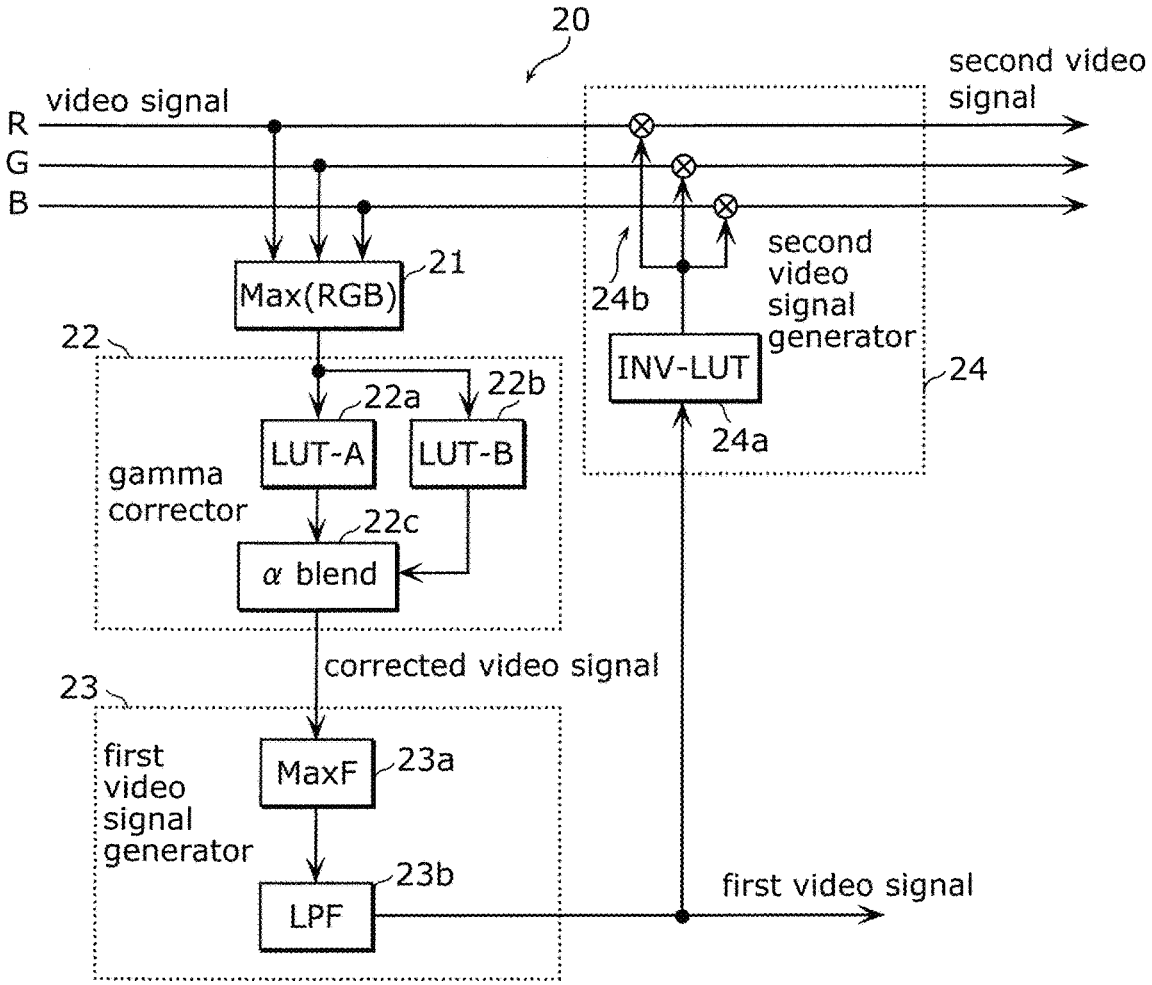
FIG. 3 is a block diagram illustrating a configuration of signal processor in FIG. 2.

FIG. 3 is a block diagram illustrating a configuration of signal processor 20 in FIG. 2. Signal processor 20 includes maximum value processor (Max (RGB)) 21, gamma corrector 22, first video signal generator 23, and second video signal generator 24. In the exemplary embodiment, the input video signal is a signal including a gradation value (R value, G value, B value) of three color components (R (red), G (green), B (blue)) for each pixel constituting the image to be displayed.

Maximum value processor 21 is a circuit that extracts a maximum value from the gradation value of each of the three color components included in the input video signal. Specifically, maximum value processor 21 selects and outputs the maximum value of the gradation value (R value, G value, B value) for each pixel with respect to the video signal. Maximum value processor 21 is an example of a processor that converts the input color video signal into the black-and-white video signal, and may be replaced with another system processor (for example, a processor that converts the color video signal into a luminance value using the R value, the G value, and the B value) that converts the input color video signal into the black-and-white video signal. Alternatively, when the input video signal includes a luminance component, maximum value processor 21 may be replaced with a processor that extracts and outputs only the luminance component from the input video signal.

Gamma corrector 22 is a circuit that generates a corrected video signal by performing gamma correction (more particularly, gamma correction using at least two types of gamma characteristics) decided depending on a first control signal input from the outside with respect to the video signal (in this case, the video signal indicating the maximum value for each pixel) output from maximum value processor 21. Gamma corrector 22 includes first look-up table (LUT-A) 22*a*, second look-up table (LUT-B) 22*b*, and an alpha blend unit (α blend) 22*c*. The first control signal is a control signal instructing a mixing ratio of the high-contrast 2D display and the 3D display in the display of liquid crystal display device 10, for example, a signal (a signal or the like provided to liquid crystal display device 10 through an operation button such as a remote controller as an example) corresponding to an instruction from the user to liquid crystal display device 10.

First look-up table 22*a* is an algorism stored in a memory. First look-up table 22*a* is data indicating the gamma characteristic (a relationship between an input gradation value and an output gradation value) for emphasizing the contrast of the video displayed on liquid crystal display device 10 as illustrated in a part (a) of FIG. 4. The gamma characteristic in the part (a) of FIG. 4 is a curve suitable for the 2D display in which the contrast is improved for liquid crystal display device 10 by providing a positive correlation between the input gradation value and the output gradation value only to the low input gradation value (that is, dark color).

Figure 4:
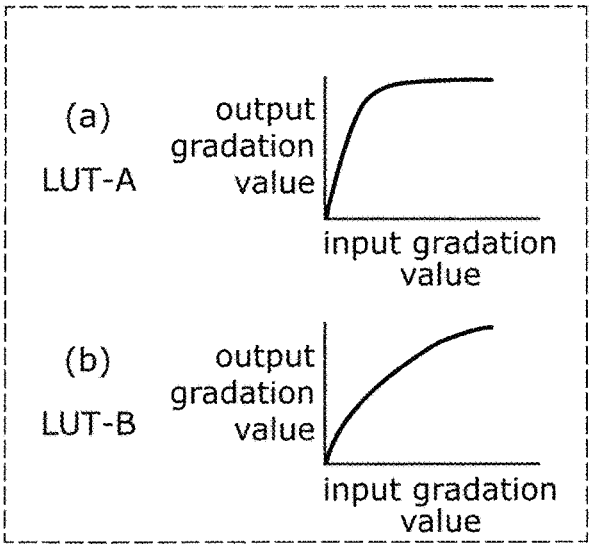
FIG. 4 is a view of examples of gamma characteristic indicated in first look-up table and second look-up table in FIG. 3.

Second look-up table 22*b* is an algorism stored in a memory, Second look-up table 22*b* is data indicating the gamma characteristic for stereoscopically displaying the video displayed on liquid crystal display device 10 as illustrated in a part (b) of FIG. 4. In the gamma characteristic in the part (b) of FIG. 4, a positive correlation between the input gradation value and the output gradation value is given over the entire input gradation value, and edge emphasis that causes the generation of the parallax in the display on first liquid crystal display panel 12 and second liquid crystal display panel 14 is performed, thereby the gamma characteristic is a curve suitable for causing liquid crystal display device 10 to perform the 3D display.

Alpha blend unit 22*c* is a circuit in which value (output gradation value) corresponding to the video signal (that is, input gradation value) output from maximum value processor 21 is read from first look-up table 22*a* and second look-up table 22*b*, and alpha blend of the read two values (output gradation values) is performed at a ratio depending on the first control signal to perform the gamma correction on the video signal. For example, assuming that A is the output gradation value read from first look-up table 22*a*, that B is the output gradation value read from second look-up table 22*b*, and that α (a value ranging from 0 to 1, inclusive) is the ratio depending on the first control signal, a calculation result of $\alpha \cdot A+(1-\alpha) \cdot B$ is output.

First video signal generator 23 is a circuit that generates the first video signal for first liquid crystal display panel 12 disposed on the back surface side using the corrected video signal output from gamma corrector 22, more particularly a circuit that performs stereoscopic vision suppression processing of suppressing stereoscopic vision due to the parallax with respect to the corrected video signal. First video signal generator 23 includes maximum value filter (MaxF) 23*a* and low-pass filter (LPF) 23*b*.

For example, for each pixel, maximum value filter 23*a* is a circuit that replaces the gradation value of the pixel with a maximum value (whitest gradation value) of the gradation values of the pixel and the peripheral pixels (for example, the total of nine pixels including the pixel and eight peripheral pixels). This corresponds to processing of expanding a white area by spreading a high gradation value (whiter color) to surrounding pixels.

For example, low-pass filter 23*b* is a circuit that spatially smooths the gradation value of the pixel, more particularly replaces, for each pixel, the gradation value of the pixel with an average value of the gradation values of the pixel and the peripheral pixels (for example, the total of nine pixels including the pixel and eight peripheral pixels).

Using maximum value filter 23*a* and low-pass filter 23*b*, first video signal generator 23 performs blurring processing after increasing the white area in first liquid crystal display panel 12, whereby the parallax problem is improved (that is, the stereoscopic vision is suppressed) when priority is given to contrast.

Second video signal generator 24 is a circuit that generates the second video signal for second liquid crystal display panel 14 disposed on the display surface side, using the first video signal output from first video signal generator 23. Second video signal generator 24 includes inverse gamma corrector (INV-LUT) 24*a* and multiplier 24*b*.

Inverse gamma corrector 24*a* is a circuit that outputs a value (that is, a coefficient) corresponding to inverse conversion of gamma correction performed by gamma corrector 22 with respect to the first video signal. For example, when α is 0.5, inverse gamma corrector 24*a* outputs the coefficient using a look-up table corresponding to the inverse conversion of the gamma correction performed by gamma corrector 22.

Multiplier 24*b* multiplies the video signal (that is, each of the R value, the G value, and the B value) input to signal processor 20 by the coefficient output from inverse gamma corrector 24*a*.

Using inverse gamma corrector 24*a* and multiplier 24*b*, second video signal generator 24 multiplies the input video signal by the value obtained by performing the inverse gamma correction on the first video signal and, as a result, generates, as the second video signal, the gradation value obtained by dividing the input video signal by the gradation value of the second video signal. Consequently, the input video signal is separated into the first video signal and the second video signal such that a result of multiplication of the gradation value of the first video signal and the gradation value of the second video signal is matched with the gradation value of the input original video signal.

Operation of liquid crystal display device 10 of the exemplary embodiment having the above configuration will be described below.

Figure 5:
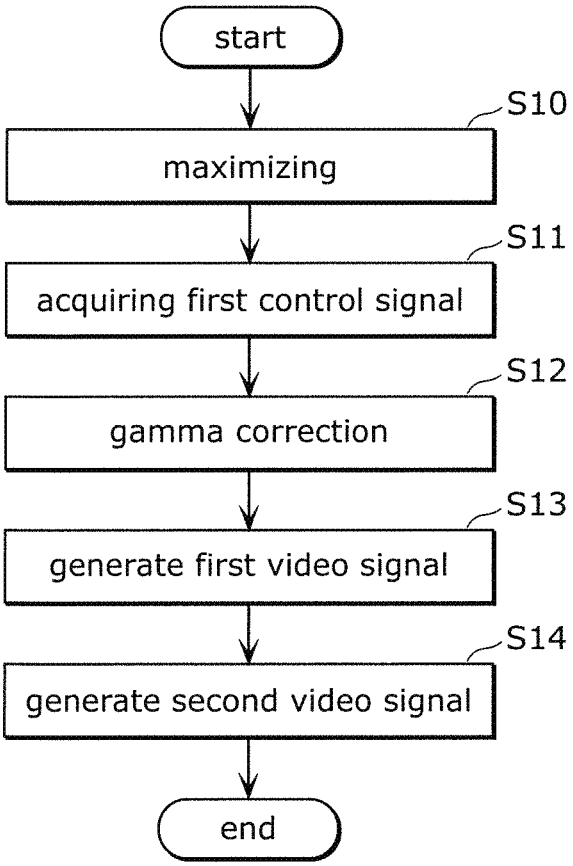
FIG. 5 is a flowchart illustrating the operation of liquid crystal display device of the exemplary embodiment in FIG. 1.

FIG. 5 is a flowchart illustrating the operation (that is, the video signal processing method) of liquid crystal display device 10 of the exemplary embodiment. Maximum value processor 21 extracts the maximum value from the gradation values of the three color components included in the input video signal (S10). Specifically, maximum value processor 21 selects and outputs the maximum value of the gradation value (R value, G value, B value) for each pixel with respect to the video signal.

Subsequently, gamma corrector 22 acquires, from the outside, a first control signal instructing the mixing ratio of the high-contrast 2D display and 3D display (S11).

Gamma corrector 22 generates the corrected video signal by performing the gamma correction decided depending on the currently-acquired first control signal on the video signal output from maximum value processor 21 (gamma correction step S12). Specifically, in gamma corrector 22, alpha blend unit 22*c* reads the values (output gradation values A and B) corresponding to the video signal (that is, the input gradation value) output from maximum value processor 21 from first look-up table 22*a* and second look-up table 22*b*, $\alpha \cdot A+(1-\alpha) \cdot B$ is calculated using ratio α depending on the first control signal, and a calculated result is output as the corrected video signal.

Subsequently, first video signal generator 23 generates the first video signal for first liquid crystal display panel 12 disposed on the back surface side using the corrected video signal output from gamma corrector 22 (first video signal generation step S13). Specifically, first video signal generator 23 performs blurring processing after increasing the white area in first liquid crystal display panel 12 by the processing using maximum value filter 23*a* and low-pass filter 23*b*, whereby the parallax problem is improved (that is, the stereoscopic vision is suppressed) when the priority is given to the contrast.

Second video signal generator 24 generates the second video signal for second liquid crystal display panel 14 disposed on the display surface side using the first video signal output from first video signal generator 23 (second video signal generation step S14). Specifically, through the processing using inverse gamma corrector 24*a* and multiplier 24*b*, second video signal generator 24 multiplies the input video signal by the value obtained by performing the inverse gamma correction on the first video signal and, as a result, generates, as the second video signal, the gradation value obtained by dividing the input video signal by the gradation value of the second video signal.

The above pieces of processing (S10 to S14) are repeated for each pixel included in the input video signal. A degree of the alpha blend is instructed to liquid crystal display device 10 using the first control signal by the video signal processing method, which allows the mixing ratio of the high-contrast 2D display and the 3D display to be changed seamlessly and linearly.

Figure 6:
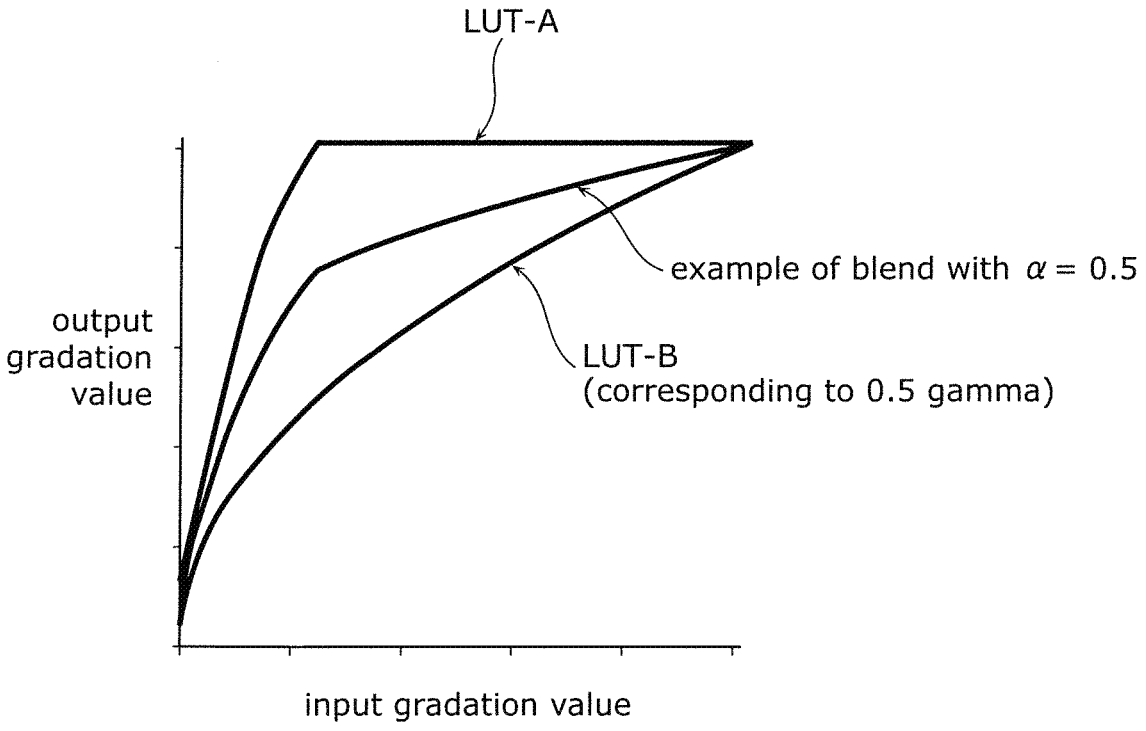
FIG. 6 is a view illustrating a processing example of the gamma correction step in FIG. 5.

FIG. 6 is a view illustrating a processing example of the gamma correction step S12 in FIG. 5. FIG. 6 illustrates the gamma characteristic (LUT-A) of first look-up table 22*a* in gamma corrector 22, the gamma characteristic (LUT-B (in this case, the gamma characteristic corresponding to 0.5 gamma)) of second look-up table 22*b*, and the gamma characteristic obtained by the alpha blend (in this case, alpha blend with $\alpha$=0.5) of alpha blend unit 22*c*. Using the gamma characteristic obtained by mixing the gamma characteristic of first look-up table 22*a* suitable for the high-contrast 2D display and the gamma characteristic of second look-up table 22*b* suitable for the 3D display, gamma corrector 22 performs the alpha blend depending on the first control signal input from the outside on the video signal output from maximum value processor 21 to perform the gamma correction that seamlessly and linearly changes the ratio of the high-contrast 2D display and the 3D display.

Figure 7:
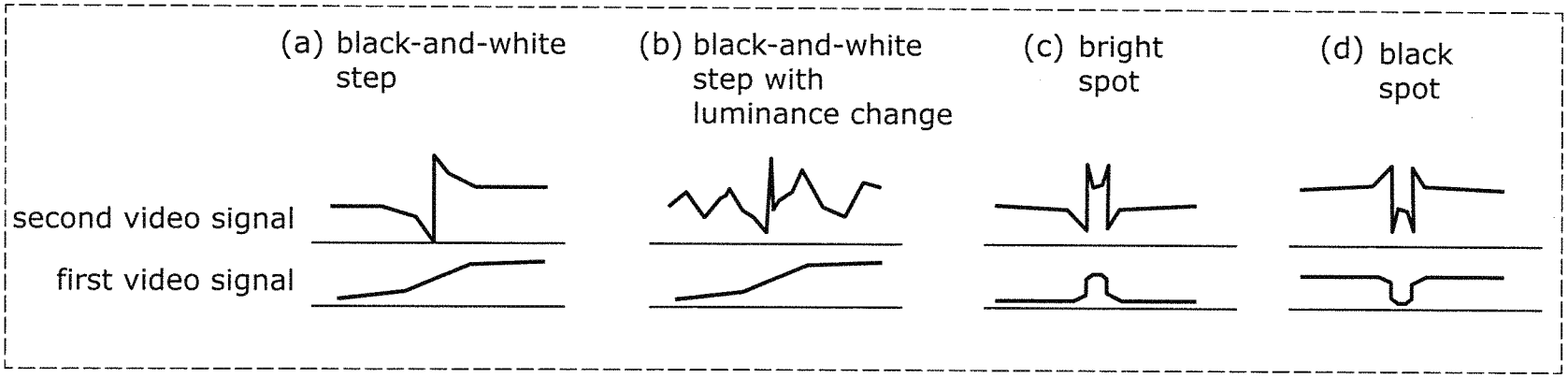
FIG. 7 is a view illustrating an example of a condition in which the display by liquid crystal display device according to the exemplary embodiment is stereoscopically viewed.

FIG. 7 is a view illustrating an example (that is, specific examples of the first video signal and the second video signal) of a condition (that is, a condition of the 3D display) in which the display by liquid crystal display device 10 according to the exemplary embodiment is stereoscopically viewed. Each of (a) to (d) in FIG. 7 illustrates an example of stereoscopic visualization of a place where a sudden change (that is, an edge) from white to black (or from black to white) exists, specifically illustrates an example of the stereoscopic visualization of a black-and-white step, a black-and-white step with a luminance change, a bright spot, and a black spot. In the parts (a) to (d) of FIG. 7, the upper drawing illustrates a luminance distribution of second liquid crystal display panel 14 disposed on the display surface side, and the lower drawing illustrates a luminance distribution of first liquid crystal display panel 12 disposed on the back surface side. The luminance distribution indicates a distribution in the case where a horizontal axis indicates a position of the pixel in one direction (for example, the horizontal direction) in the liquid crystal display panel while a vertical axis indicates the luminance (whiter as the luminance is higher).

In any examples of the parts (a) to (d) in FIG. 7, as illustrated in the lower drawing, a signal that is gradually changed from black to white (that is, gradually becomes white) is generated as the first video signal for first liquid crystal display panel 12 at a place where black is suddenly changed to white (that is, the signal is suddenly becomes white) according to the spatial position by the processing (specifically, the alpha blend at $\alpha$=0) of gamma corrector 22 and the processing (that is, the blurring processing) of low-pass filter 23*b* of first video signal generator 23. As a result, as illustrated in the upper drawing, a signal suitable for the stereoscopic vision in which the luminance change from white to black is emphasized is generated as the second video signal for second liquid crystal display panel 14 by the processing (that is, processing of dividing the input video signal by the gradation value of the first video signal) of inverse gamma corrector 24*a* on the first video signal.

At this point, in liquid crystal display device 10 of the exemplary embodiment, the stereoscopic vision condition is satisfied when the luminance distribution of the input video signal to the first video signal and the second video signal becomes 0.5:0.5. This corresponds to a case of $\alpha$=0 (that is, a case where 100% of a component of the second look-up table 22*b* for the 3D display is adopted) in the alpha blend of gamma corrector 22. In such cases, the luminance characteristic is equivalent to an original image (that is, the input video signal) when liquid crystal display device 10 is viewed from a front, and the stereoscopic vision state is obtained at the edge portion when liquid crystal display device 10 is obliquely viewed. The luminance characteristic is equivalent to the original image in viewing liquid crystal display device 10 from the front because inverse gamma corrector 24*a* performs processing on the first video signal as the second video signal (that is, performs processing of dividing the input video signal by the gradation value of the first video signal).

In the display in which the priority is given to the stereoscopic vision, when liquid crystal display device 10 is obliquely viewed, stereoscopic edge emphasis expression is obtained, but contrast-emphasized 2D display is not obtained. For this reason, when the priority is given to the high-contrast 2D display, it is necessary to relax the edge emphasis expression. The relaxation of the edge emphasis expression can be obtained by performing the alpha blend in which a is brought close to 1 in the gamma corrector 22 (that is, first look-up table 22*a* for the 2D display is preferentially adopted). In first look-up table 22*a*, the positive correlation between the input gradation value and the output gradation value exists only for the low input gradation value, and the output gradation value becomes a saturated value for the higher input gradation value. For this reason, the stereoscopic vision suppression processing is effectively performed in first video signal generator 23 by the alpha blend in which first look-up table 22*a* is preferentially adopted, and resultantly the high-contrast 2D display is performed with higher contrast than the stereoscopic vision.

A display example (display examples of first liquid crystal display panel 12 and second liquid crystal display panel 14) of liquid crystal display device 10 of the exemplary embodiment will be described below with reference to FIGS. 8 and 11.

Figure 8:
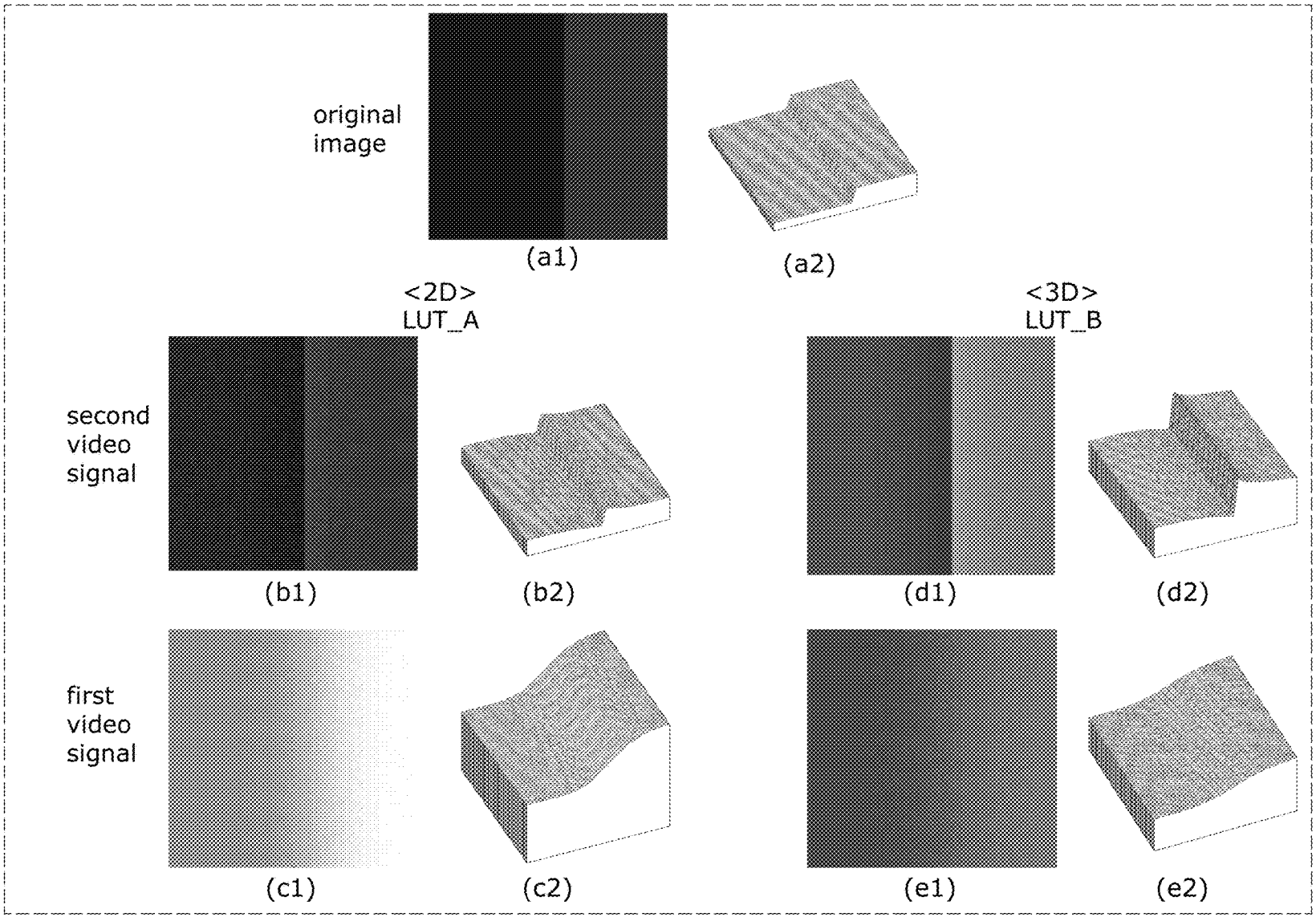
FIG. 8 is a view illustrating a display example when the high-contrast 2D display and the 3D display are input in the case where the original image having the black-and-white step is input to liquid crystal display device in FIG. 1.

FIG. 8 is a view illustrating a display example (display examples of first liquid crystal display panel 12 and second liquid crystal display panel 14) when the high-contrast 2D display ($\alpha$=1) and the 3D display ($\alpha$=0) are input in the case where the original image having the black-and-white step is input to liquid crystal display device 10.

Parts (a1) and (a2) of FIG. 8 illustrate the original image and the luminance characteristic of the original image, respectively. The luminance characteristic represents the luminance of each of the pixels arranged two-dimensionally as a vertical axis (height in three-dimensional display), and can also be regarded as light transmittance. As illustrated in the parts (a1) and (a2) of FIG. 8, the original image is an image having a black-and-white step where a left half is black while a right half is gray.

Parts (b1), (b2), (c1), and (c2) of FIG. 8 illustrate the images represented by the first video signal and the second video signal when liquid crystal display device 10 performs the high-contrast 2D display ($\alpha$=1), and illustrate the image represented by the second video signal, the luminance characteristic of the image represented by the second video signal, the image represented by the first video signal, and the luminance characteristic of the image represented by the first video signal, respectively. As described above, when the high-contrast 2D display ($\alpha$=1) is performed, the first video signal represents the image in which white is emphasized on the whole by the alpha blend in which first look-up table 22*a* is preferentially adopted as illustrated in the parts (c1) and (c2) of FIG. 8, and the second video signal represents the image obtained by dividing the luminance value of the image in the part (a1) of FIG. 8 by the luminance value of the image in the part (c1) of FIG. 8, namely, the image in which the edge emphasis is suppressed as illustrated in the parts (b1) and (b2) of FIG. 8. Consequently, the high-contrast 2D display can be obtained when the image based on the first video signal and the image based on the second video signal are viewed while superimposed on each other.

Parts (d1), (d2), (e1), and (e2) of FIG. 8 illustrate the images represented by the first video signal and the second video signal when liquid crystal display device 10 performs the 3D display ($\alpha$=0), and illustrate the image represented by the second video signal, the luminance characteristic of the image represented by the second video signal, the image represented by the first video signal, and the luminance characteristic of the image represented by the first video signal, respectively. As described above, when the 3D display ($\alpha$=0) is performed, the first video signal represents the image in which black is emphasized on the whole by the alpha blend in which second look-up table 22*b* is preferentially adopted as illustrated in the parts (e1) and (e2) of FIG. 8, and the second video signal represents the image obtained by dividing the luminance value of the image in the part (a1) of FIG. 8 by the luminance value of the image in the part (e1) of FIG. 8, namely, the image in which the edge is emphasized as illustrated in the parts (d1) and (d2) of FIG. 8. Consequently, the 3D display in which the edge is emphasized can be obtained when the image based on the first video signal and the image based on the second video signal are viewed while superimposed on each other.

Figure 9:
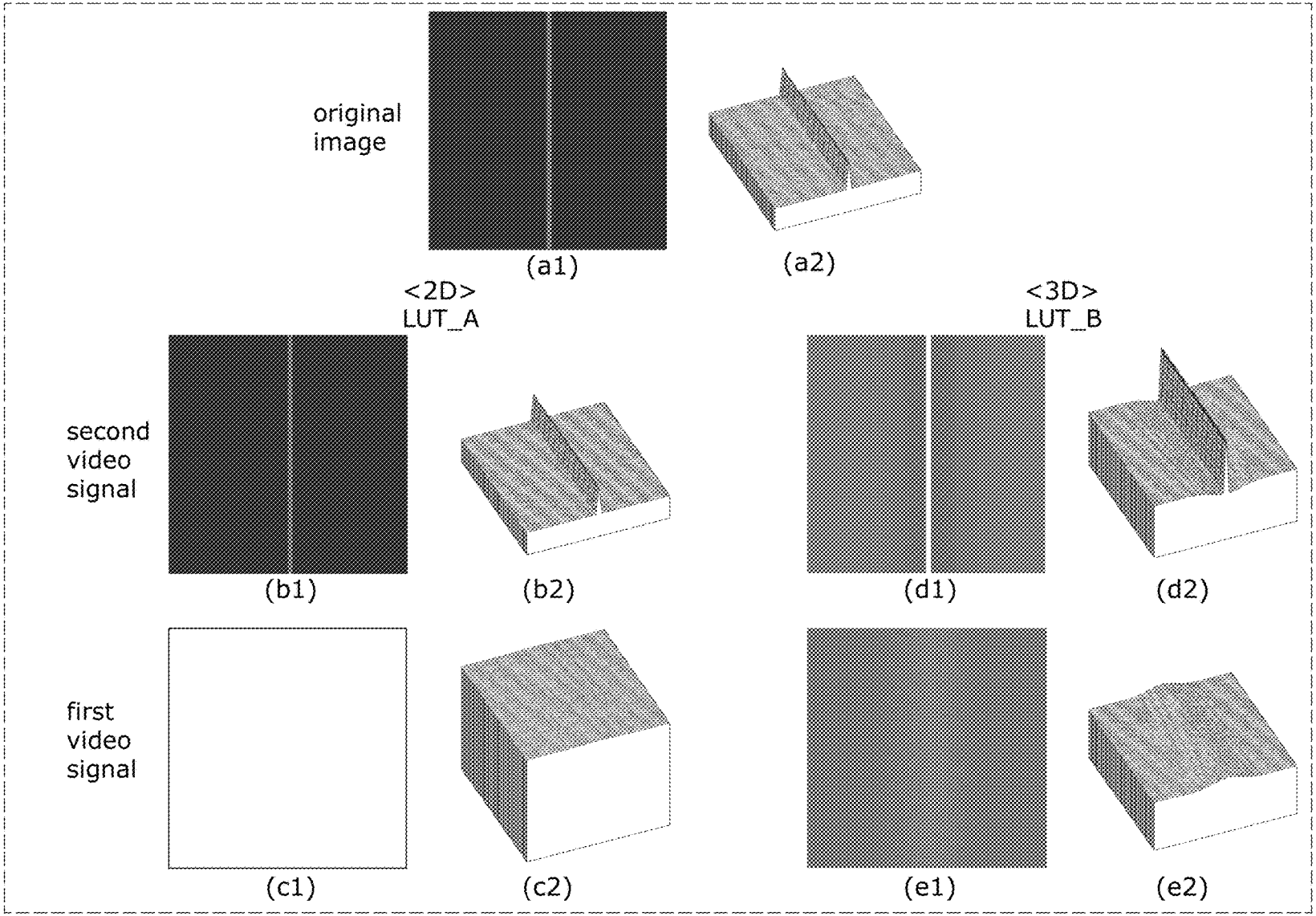
FIG. 9 is a view illustrating a display example when the high-contrast 2D display and the 3D display are input in the case where the original image having a bright line is input to liquid crystal display device in FIG. 1.

FIG. 9 is a view illustrating a display example (display examples of first liquid crystal display panel 12 and second liquid crystal display panel 14) when the high-contrast 2D display ($\alpha$=1) and the 3D display ($\alpha$=0) are input in the case where the original image having a bright line is input to liquid crystal display device 10.

Parts (a1) and (a2) of FIG. 9 illustrate the original image and the luminance characteristic of the original image, respectively. As illustrated in the parts (a1) and (a2) of FIG. 9, the original image is an image having the bright line (in this case, a gray vertical line) running vertically in the center of the black background.

Parts (b1), (b2), (c1), and (c2) of FIG. 9 illustrate the images represented by the first video signal and the second video signal when liquid crystal display device 10 performs the high-contrast 2D display ($\alpha$=1), and illustrate the image represented by the second video signal, the luminance characteristic of the image represented by the second video signal, the image represented by the first video signal, and the luminance characteristic of the image represented by the first video signal, respectively. As described above, when the high-contrast 2D display ($\alpha$=1) is performed, the first video signal represents the overall white image in which the gradation is rarely changed by the alpha blend in which first look-up table 22*a* is preferentially adopted as illustrated in the parts (c1) and (c2) of FIG. 9, and the second video signal represents the image obtained by dividing the luminance value of the image in the part (a1) of FIG. 9 by the luminance value of the image in the part (c1) of FIG. 9, namely, the image in which the edge emphasis is suppressed as illustrated in the parts (b1) and (b2) of FIG. 9. Consequently, the high-contrast 2D display can be obtained when the image based on the first video signal and the image based on the second video signal are viewed while superimposed on each other.

Parts (d1), (d2), (e1), and (e2) of FIG. 9 illustrate the images represented by the first video signal and the second video signal when liquid crystal display device 10 performs the 3D display ($\alpha$=0), and illustrate the image represented by the second video signal, the luminance characteristic of the image represented by the second video signal, the image represented by the first video signal, and the luminance characteristic of the image represented by the first video signal, respectively. As described above, when the 3D display ($\alpha$=0) is performed, the first video signal represents the image in which the gradation is changed in the center by the alpha blend in which second look-up table 22*b* is preferentially adopted as illustrated in the parts (e1) and (e2) of FIG. 9, and the second video signal represents the image obtained by dividing the luminance value of the image in the part (a1) of FIG. 9 by the luminance value of the image in the part (e1) of FIG. 9, namely, the image in which the edge is emphasized as illustrated in the parts (d1) and (d2) of FIG. 9. Consequently, the 3D display in which the edge is emphasized can be obtained when the image based on the first video signal and the image based on the second video signal are viewed while superimposed on each other.

Figure 10:
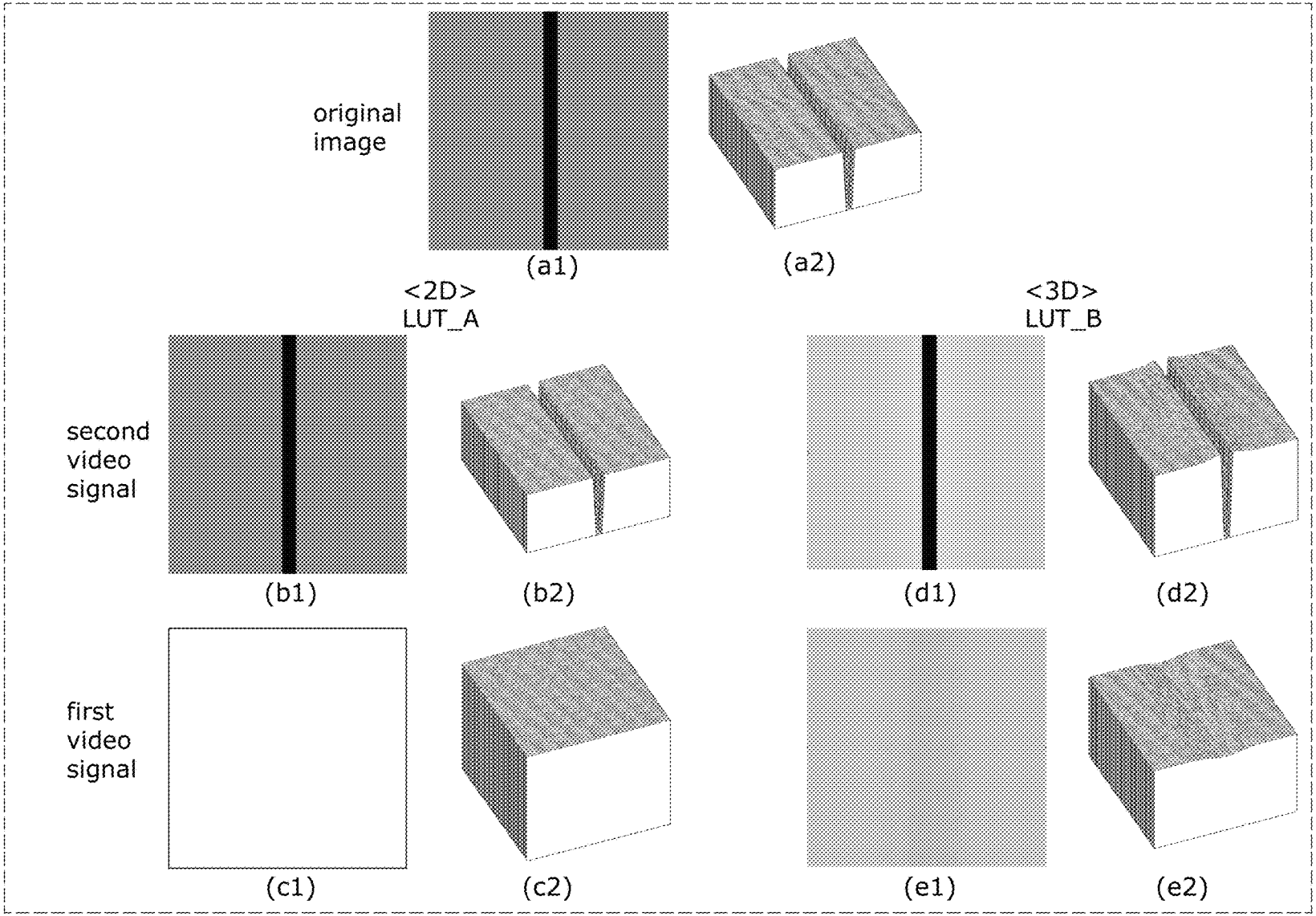
FIG. 10 is a view illustrating a display example when the high-contrast 2D display and the 3D display are input in the case where the original image having a black line is input to liquid crystal display device in FIG. 1.

FIG. 10 is a view illustrating a display example (display examples of first liquid crystal display panel 12 and second liquid crystal display panel 14) when the high-contrast 2D display ($\alpha$=1) and the 3D display ($\alpha$=0) are input in the case where the original image having a black line is input to liquid crystal display device 10.

Parts (a1) and (a2) of FIG. 10 illustrate the original image and the luminance characteristic of the original image, respectively. As illustrated in the parts (a1) and (a2) of FIG. 10, the original image is an image having a black line running vertically in the center of the gray background.

Parts (b1), (b2), (c1), and (c2) of FIG. 10 illustrate the images represented by the first video signal and the second video signal when liquid crystal display device 10 performs the high-contrast 2D display ($\alpha$=1), and illustrate the image represented by the second video signal, the luminance characteristic of the image represented by the second video signal, the image represented by the first video signal, and the luminance characteristic of the image represented by the first video signal, respectively. As described above, when the high-contrast 2D display ($\alpha$=1) is performed, the first video signal represents the overall white image in which the gradation is rarely changed by the alpha blend in which first look-up table 22*a* is preferentially adopted as illustrated in the parts (c1) and (c2) of FIG. 10, and the second video signal represents the image obtained by dividing the luminance value of the image in the part (a1) of FIG. 10 by the luminance value of the image in the part (c1) of FIG. 10, namely, the image in which the edge emphasis is suppressed as illustrated in the parts (b1) and (b2) of FIG. 10. Consequently, the high-contrast 2D display can be obtained when the image based on the first video signal and the image based on the second video signal are viewed while superimposed on each other.

Parts (d1), (d2), (e1), and (e2) of FIG. 10 illustrate the images represented by the first video signal and the second video signal when liquid crystal display device 10 performs the 3D display ($\alpha$=0), and illustrate the image represented by the second video signal, the luminance characteristic of the image represented by the second video signal, the image represented by the first video signal, and the luminance characteristic of the image represented by the first video signal, respectively. As described above, when the 3D display ($\alpha$=0) is performed, the first video signal represents the image in which the gradation is changed in the center by the alpha blend in which second look-up table 22*b* is preferentially adopted as illustrated in the parts (e1) and (e2) of FIG. 10, and the second video signal represents the image obtained by dividing the luminance value of the image in the part (a1) of FIG. 10 by the luminance value of the image in the part (e1) of FIG. 10, namely, the image in which the edge is emphasized as illustrated in the parts (d1) and (d2) of FIG. 10. Consequently, the 3D display in which the edge is emphasized can be obtained when the image based on the first video signal and the image based on the second video signal are viewed while superimposed on each other.

Figure 11:
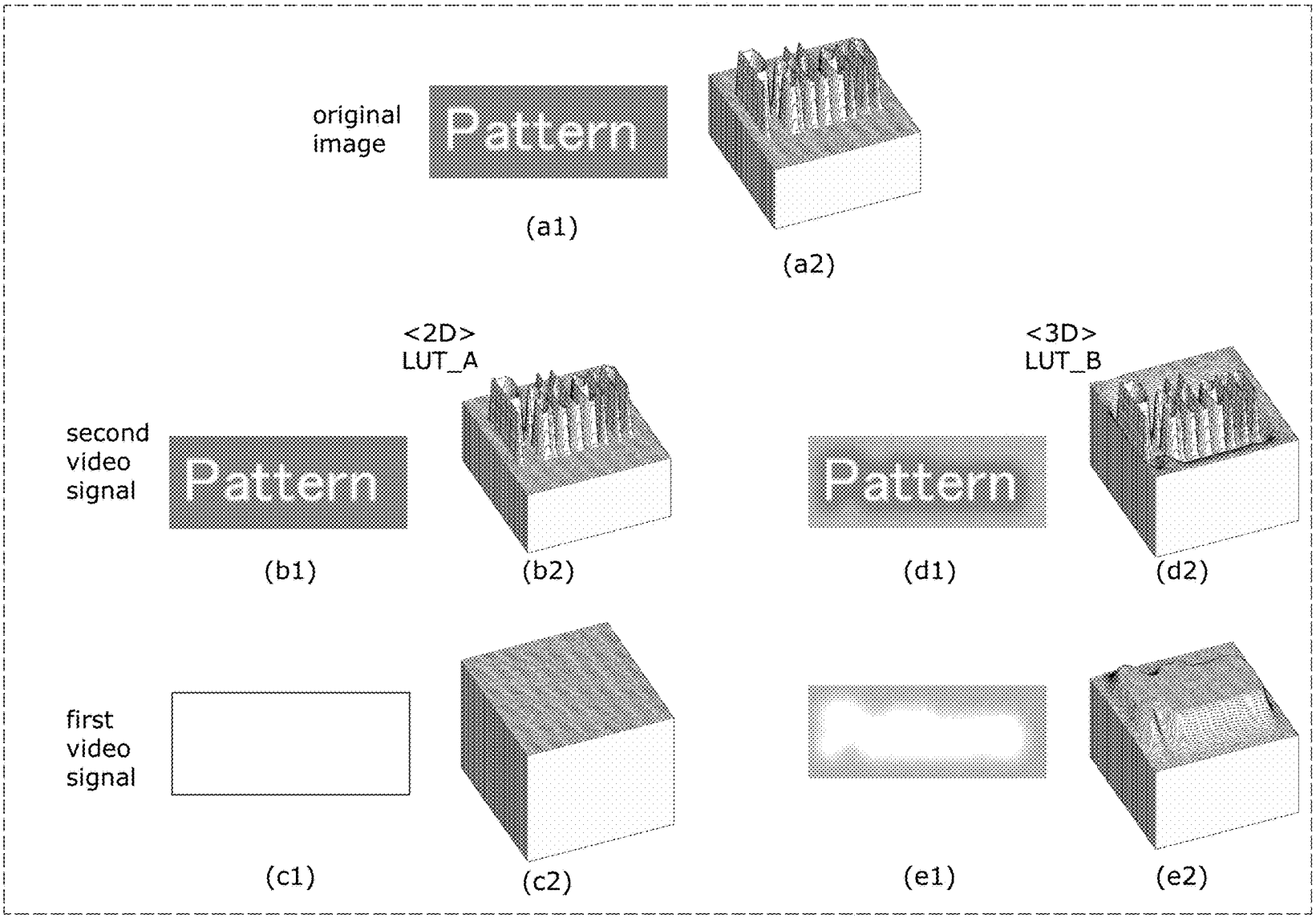
FIG. 11 is a view illustrating a display example when the high-contrast 2D display and the 3D display are input in the case where the original image expressing a character string is input to liquid crystal display device in FIG. 1.

FIG. 11 is a view illustrating a display example (display examples of first liquid crystal display panel 12 and second liquid crystal display panel 14) when the high-contrast 2D display ($\alpha$=1) and the 3D display ($\alpha$=0) are input in the case where the original image expressing a character string is input to liquid crystal display device 10.

Parts (a1) and (a2) of FIG. 11 illustrate the original image and the luminance characteristic of the original image, respectively. As illustrated in (a1) and (a2) of FIG. 11, the original image is an image having an outlined character string in a gray rectangular background.

Parts (b1), (b2), (c1), and (c2) of FIG. 11 illustrate the images represented by the first video signal and the second video signal when liquid crystal display device 10 performs the high-contrast 2D display ($\alpha$=1), and illustrate the image represented by the second video signal, the luminance characteristic of the image represented by the second video signal, the image represented by the first video signal, and the luminance characteristic of the image represented by the first video signal, respectively. As described above, when the high-contrast 2D display ($\alpha$=1) is performed, the first video signal represents the overall white image in which the gradation is rarely changed by the alpha blend in which first look-up table 22*a* is preferentially adopted as illustrated in the parts (c1) and (c2) of FIG. 11, and the second video signal represents the image obtained by dividing the luminance value of the image in the part (a1) of FIG. 11 by the luminance value of the image in the part (c1) of FIG. 11, namely, the image in which the edge emphasis is suppressed as illustrated in the parts (b1) and (b2) of FIG. 11. Consequently, the high-contrast 2D display can be obtained when the image based on the first video signal and the image based on the second video signal are viewed while superimposed on each other.

Parts (d1), (d2), (e1), and (e2) of FIG. 11 illustrate the images represented by the first video signal and the second video signal when liquid crystal display device 10 performs the 3D display ($\alpha$=0), and illustrate the image represented by the second video signal, the luminance characteristic of the image represented by the second video signal, the image represented by the first video signal, and the luminance characteristic of the image represented by the first video signal, respectively. As described above, when the 3D display ($\alpha$=0) is performed, the first video signal represents the image having the gradation change in which a character-string place is white in a gray rectangular region by the alpha blend in which second look-up table 22*b* is preferentially adopted as illustrated in the parts (e1) and (e2) of FIG. 11, and the second video signal represents the image obtained by dividing the luminance value of the image in the part (a1) of FIG. 11 by the luminance value of the image in the part (e1) of FIG. 11, namely, the character-string image in which the edge is emphasized as illustrated in the parts (d1) and (d2) of FIG. 11. Consequently, the character-string 3D display in which the edge is emphasized can be obtained when the image based on the first video signal and the image based on the second video signal are viewed while superimposed on each other.

As described above, liquid crystal display device 10 of the exemplary embodiment is the liquid crystal display device that displays the input video signal, the liquid crystal display device including: first liquid crystal display panel 12 and second liquid crystal display panel 14 disposed to be laminated; gamma corrector 22 that generates the corrected video signal by performing the gamma correction decided depending on the first control signal input from the outside with respect to the video signal; first video signal generator 23 that generates the first video signal for first liquid crystal display panel 12 using the corrected video signal; and second video signal generator 24 that generates the second video signal for second liquid crystal display panel 14 using the first video signal.

The video signal processing method of the exemplary embodiment is the video signal processing method performed by liquid crystal display device 10 including first liquid crystal display panel 12 and second liquid crystal display panel 14 disposed to be laminated, the video signal processing method including: the gamma correction step S12 of generating the corrected video signal by performing the gamma correction decided depending on the first control signal input from the outside with respect to the input video signal; the first video signal generation step S13 of generating the first video signal for first liquid crystal display panel 12 using the corrected video signal; and the second video signal generating step S14 of generating the second video signal for second liquid crystal display panel 14 using the first video signal.

Consequently, the first video signal is generated by performing the gamma correction decided depending on the first control signal input from the outside with respect to the input video signal, and the second video signal is generated based on the first video signal. Because the characteristic of the gamma correction can be changed by external control, for example, the signal indicating the mixing ratio of the high-contrast 2D display and the 3D display is used as the first control signal, thereby constructing liquid crystal display device 10 suitable for seamlessly and linearly changing the mixing ratio of the high-contrast 2D display and the 3D display.

That is, gamma corrector 22 performs the gamma correction using at least two types of the gamma characteristics.

Specifically, gamma corrector 22 holds the two look-up tables (first look-up table 22*a* and second look-up table 22*b*) indicating the two types of the gamma characteristics, reads two values corresponding to the video signal from the two look-up tables, performs alpha blend on the read two values at a ratio depending on the first control signal, and performs the gamma correction on the video signal. At this point, the two types of the gamma characteristics are the gamma characteristic for emphasizing the contrast of the video displayed on liquid crystal display device 10 and the gamma characteristic for stereoscopically displaying the video displayed on liquid crystal display device 10.

Consequently, the first video signal is generated by the integrated gamma characteristic obtained by mixing the gamma characteristic for emphasizing the contrast of the video and the gamma characteristic for stereoscopically displaying the video at the ratio depending on the first control signal input from the outside, so that liquid crystal display device 10 suitable for seamlessly and linearly changing the mixing ratio of the high-contrast 2D display and the 3D display linearly can be constructed.

Second video signal generator 24 generates the second video signal by multiplying the video signal by the value obtained by performing the inverse gamma correction on the first video signal. Consequently, because the gradation value obtained by dividing the input video signal by the gradation value of the second video signal is generated as the second video signal, the result obtained by multiplying the gradation value of the first video signal by the gradation value of the second video signal is matched with the gradation value of the input original video signal, and the luminance characteristic of the input original video signal is reproduced when first liquid crystal display panel 12 and second liquid crystal display panel 14 are viewed while superimposed on each other.

The video signal includes gradation values of three color components. Liquid crystal display device 10 further includes maximum value processor 21 that extracts the maximum value from the gradation values of the three color components included in the video signal. Gamma corrector 22 performs the gamma correction on the maximum value extracted by maximum value processor 21. Consequently, the simple processing of maximizing the three color components generates the black-and-white video signal necessary for the high contrast and the 3D image from the color video signal.

The first video signal generator that performs the stereoscopic vision suppression processing is not limited to first video signal generator 23 of the exemplary embodiment.

Figure 12:
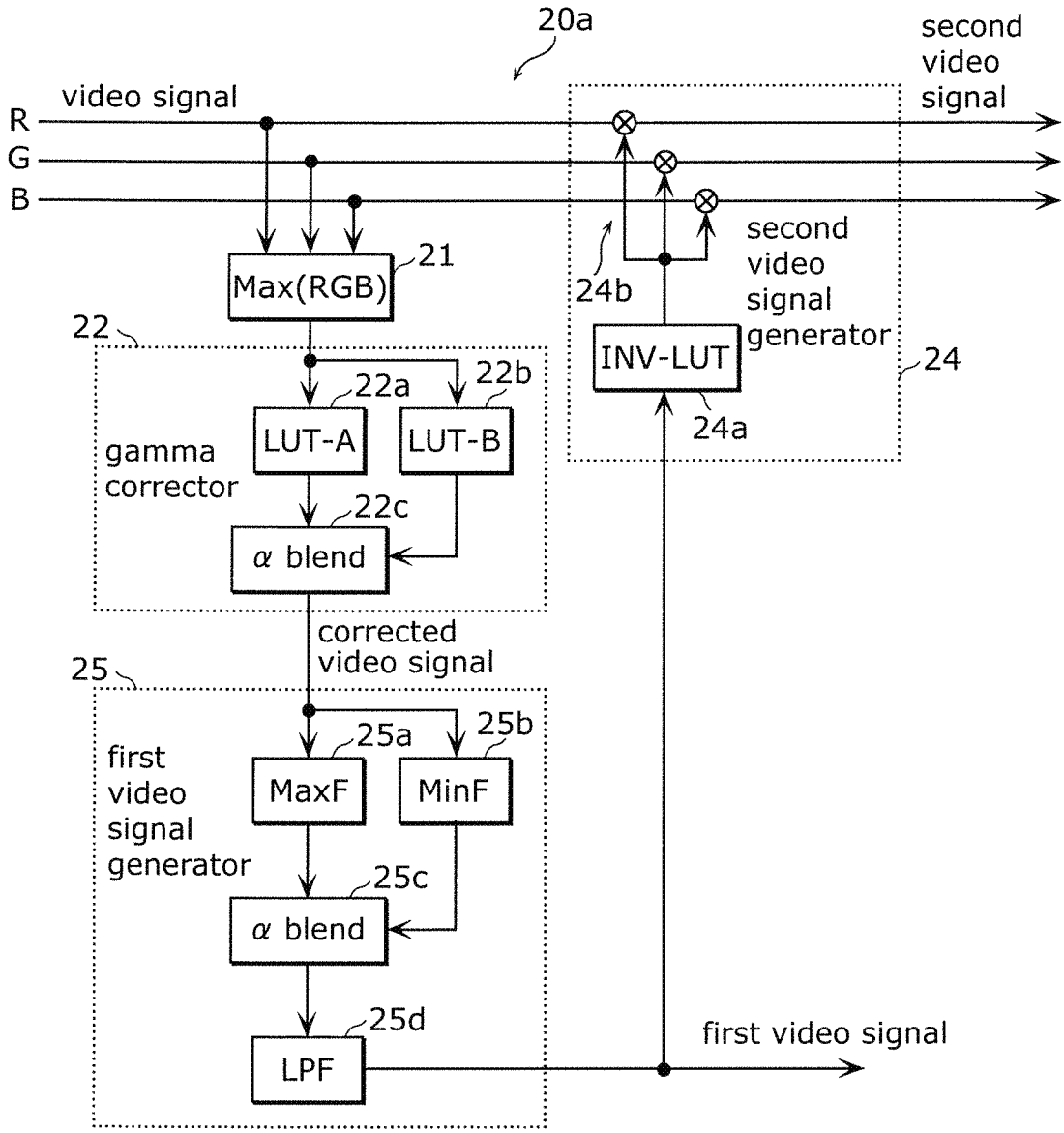
FIG. 12 is a block diagram illustrating a configuration of signal processor including first video signal generator according to a modification of the exemplary embodiment.

FIG. 12 is a block diagram illustrating a configuration of signal processor 20*a* including first video signal generator 25 according to a modification of the exemplary embodiment. Signal processor 20*a* of the modification includes first video signal generator 25 of the modification instead of first video signal generator 23 in the signal processor 20 of the exemplary embodiment.

First video signal generator 25 is a circuit that generates the first video signal for first liquid crystal display panel 12 disposed on the back surface side using the corrected video signal output from gamma corrector 22, more particularly a circuit that performs the stereoscopic vision suppression processing of suppressing the stereoscopic vision due to the parallax with intensity depending on a second control signal input from the outside with respect to the corrected video signal. First video signal generator 25 includes maximum value filter (MaxF) 25*a*, minimum value filter (MinF) 25*b*, alpha blend unit (α blend) 25*c*, and low-pass filter (LPF) 25*d*. The second control signal is a control signal instructing a mixing ratio of the high-contrast 2D display and the 3D display in the display of liquid crystal display device 10, for example, a signal (a signal or the like provided to liquid crystal display device 10 through an operation button such as a remote controller as an example) corresponding to an instruction from the user to liquid crystal display device 10.

Maximum value filter 25*a* is a circuit that performs the filtering processing of replacing the gradation value of the pixel indicated by the corrected video signal output from gamma corrector 22 with the maximum value in the gradation values of the pixel and a plurality of pixels adjacent to the pixel (for example, the total of nine pixels including the pixel and the eight peripheral pixels). This is processing of expanding the white area by spreading the high gradation value (whiter color) to surrounding pixels, and exhibits an effect that suppresses the stereoscopic vision.

Minimum value filter 25*b* is a circuit that performs filtering processing of replacing the gradation value of the pixel indicated by the corrected video signal output from gamma corrector 22 with the minimum value in the gradation values of the pixel and a plurality of pixels adjacent to the pixel (for example, the total of nine pixels including the pixel and the eight peripheral pixels). This is processing of expanding the black area by spreading the low gradation value (blacker color) to surrounding pixels, and exhibits an effect that emphasizes the stereoscopic vision.

Alpha blend unit 25*c* is a circuit that performs the alpha blend on the two gradation values obtained using maximum value filter 25*a* and minimum value filter 25*b* at the ratio depending on the second control signal. For example, assuming that A is the output gradation value read from maximum value filter 25*a*, that B is the output gradation value read from minimum value filter 25*b*, and that ß (a value ranging from 0 to 1, inclusive) is the ratio depending on the second control signal, a calculation result of $ß \cdot A + (1-ß) \cdot B$ is output.

Low-pass filter 25*d* is a circuit that spatially smooths the gradation value of the pixel, more particularly a circuit that outputs first video signal by replacing, for each pixel, the gradation value of the pixel with the average value of the gradation values of the pixel and the peripheral pixels (for example, the total of nine pixels including the pixel and eight peripheral pixels) using the gradation value output from alpha blend unit 25*c*.

Figure 13:
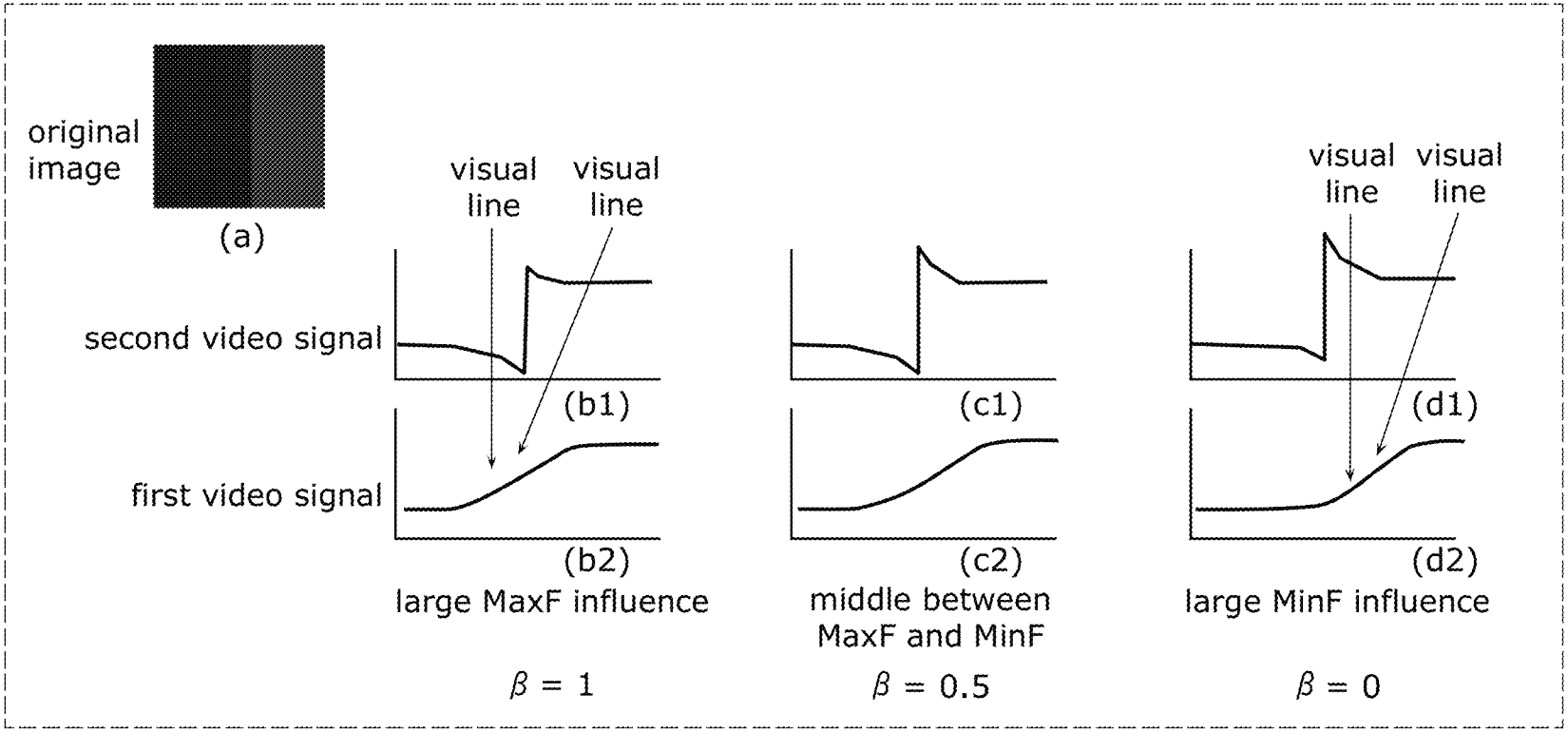
FIG. 13 is a view illustrating a processing example of first video signal generator in FIG. 12.

FIG. 13 is a view illustrating a processing example of first video signal generator 25 in FIG. 12. FIG. 13 illustrates how the luminance distributions of the first video signal and the second video signal depend on the ratio ß depending on the second control signal when the original image having the black-and-white step is input to signal processor 20*a*. A part (a) of FIG. 13 illustrates an example of the original image having the black-and-white steps input to signal processor 20*a*. Parts (b1) and (b2) of FIG. 13 illustrate the luminance distributions of the second video signal and the first video signal when ß=1, respectively. Parts (c1) and (c2) of FIG. 13 illustrate the luminance distributions of the second video signal and the first video signal when ß=0.5, respectively. Parts (d1) and (d2) of FIG. 13 illustrate the luminance distributions of the second video signal and the first video signal when ß=0, respectively.

As illustrated in the parts (b1) and (b2) of FIG. 13, for ß=1, 100% of maximum value filter 25*a* is adopted in alpha blend unit 25*c*, so that the place having the large luminance change in the first video signal is brought close to the low gradation value (that is, the black region) in the second video signal. Thus, as in a line of sight in FIG. 13, the gradation of the first video signal is located below the black-and-white step, a shadow caused by the parallax is hardly seen, and resultantly the stereoscopic vision is suppressed to perform the high-contrast 2D display.

As illustrated in the parts (c1) and (c2) of FIG. 13, for ß=0.5, 50% of maximum value filter 25*a* and 50% of minimum value filter 25*b* are adopted in alpha blend unit 25*c*. Thus, the display having the same weight of the display characteristic (that is, the high-contrast 2D display) for ß=1 illustrated in the parts (b1) and (b2) of FIG. 13 and the display characteristic (that is, the 3D display) for ß=0 illustrated in the parts (d1) and (d2) of FIG. 13 is performed.

As illustrated in the parts (d1) and (d2) of FIG. 13, for ß=0, 100% of minimum value filter 25*b* is adopted in alpha blend unit 25*c*, so that the place having the large luminance change in the first video signal is brought close to the high gradation value (that is, the white region) in the second video signal. Thus, as in the line of sight in FIG. 13, the gradation of the first video signal is located below the white region, the shadow caused by the parallax is easily seen, and resultantly the stereoscopic vision is emphasized to perform the 3D display.

As described above, first video signal generator 25 of the modification of the exemplary embodiment performs the stereoscopic vision suppression processing of suppressing the stereoscopic vision due to the parallax on the corrected video signal output from gamma corrector 22 with strength depending on the second control signal input from the outside. Consequently, as the method for changing the mixing ratio of the high-contrast 2D display and the 3D display, adjustment is performed by first video signal generator 25 using the second control signal in addition to adjustment performed by gamma corrector 22 using the first control signal, so that the mixing ratio of the high-contrast 2D display and the 3D display can more seamlessly and linearly be changed.

First video signal generator 25 performs the stereoscopic vision suppression processing using at least two types of the filtering processing. More specifically, first video signal generator 25 includes: maximum value filter 25*a* that replaces the gradation value of the pixel indicated by the corrected video signal with the maximum value of the gradation values of the pixel and the plurality of pixels adjacent to the pixel; and minimum value filter 25*b* that replaces the gradation value of the pixel with the minimum value of the gradation values of the pixel and the plurality of pixels adjacent to the pixel, and first video signal generator 25 performs the stereoscopic vision suppression processing on the corrected video signal by performing the alpha blend of the two gradation values obtained using maximum value filter 25*a* and minimum value filter 25*b* with respect to the corrected video signal at the ratio depending on the second control signal. First video signal generator 25 further includes low-pass filter 25*d* that generates the first video signal by spatially smoothing the gradation value alpha-blended at a ratio depending on the second control signal.

Consequently, the first video signal is generated by the filtering processing in which the processing of suppressing the stereoscopic vision using maximum value filter 25*a* and the processing of emphasizing the stereoscopic vision using minimum value filter 25*b* are integrated at the ratio depending on the second control signal input from the outside, so that the liquid crystal display device suitable for more seamlessly and linearly changing the mixing ratio of the high-contrast 2D display and the 3D display can be constructed.

The liquid crystal display device and the video signal processing method of the present disclosure is described above based on the exemplary embodiment and the modification. However, the present disclosure is not limited to the exemplary embodiment and the modification. It is understood that various changes of the exemplary embodiment and the modification that are conceived by those skilled in the art, and other exemplary embodiments obtained by a combination of components of the exemplary embodiment and the modification are also included within the scope of the present disclosure as long as these do not depart from the main purport of the present disclosure.

For example, in the exemplary embodiment, the input video signal is the color signal including the R value, the G value, and the B value. However, the input video signal is not limited to this type of signal. The input video signal may be a color difference signal including Y, Cb, and Cr or a black-and-white signal. Gamma corrector 22 and first video signal generators 23 and 25 of the exemplary embodiment perform the processing on the black-and-white signal converted from the input video signal, so that the processing can be performed without depending on the type of the input video signal.

In the exemplary embodiment and the modification, the signal corresponding to the instruction from the user to liquid crystal display device 10 is cited as the first control signal and the second control signal. However, the signal is not limited to the first control signal and the second control signal. For example, a signal type determination circuit that determines suitability for the 2D display and the 3D display according to the type of the input video signal and outputs the suitability as the first control signal and the second control signal may be provided. As an example, an image type determination circuit that generates the first control signal and the second control signal according to a number of blood vessels in the input medical image may be provided.

In the exemplary embodiment and the modification, alpha blend units 22*c* and 25*c* perform the alpha blend at the ratio depending on the first control signal and the second control signal, respectively. Alternatively, the first control signal and the second control signal may be signals directly or indirectly indicating α and ß, respectively. The first control signal and the second control signal may be independent and separate signals, or the same signal.

In the exemplary embodiment and the modification, gamma corrector 22 operates depending on the first control signal, and first video signal generator 25 operates depending on the second control signal. However, gamma corrector 22 and first video signal generator 25 do not necessarily operate depending on the control signal from the outside. For example, one of the first control signal and the second control signal may indicate fixed α/ß. This is because the mixing ratio of the high-contrast 2D display and the 3D display can seamlessly and linearly be changed by operating at least one of gamma corrector 22 and first video signal generator 25 depending on the control signal from the outside.

The present disclosure is suitable as a liquid crystal display device including two liquid crystal display panels disposed to be laminated, particularly as a liquid crystal display device suitable for seamlessly and linearly changing the mixing ratio of the high-contrast 2D display and the 3D display. For example, the present disclosure can be used as a liquid crystal display device for displaying the medical image.

What is claimed is:

1. A liquid crystal display device that displays an input video signal, the liquid crystal display device comprising:

a first liquid crystal display panel and a second liquid crystal display panel disposed to be laminated;

a gamma corrector that generates a corrected video signal by performing gamma correction decided depending on a first control signal input from an outside source with respect to the video signal;

a first video signal generator that generates a first video signal for the first liquid crystal display panel using the corrected video signal; and a second video signal generator that generates a second video signal for the second liquid crystal display panel using the first video signal, wherein the gamma corrector performs the gamma correction using at least two types of gamma characteristics, and the two types of the gamma characteristics are a gamma characteristic for emphasizing contrast of a video displayed on the liquid crystal display device and a gamma characteristic for stereoscopically displaying the video displayed on the liquid crystal display device.

2. The liquid crystal display device according to claim 1, wherein the gamma corrector:

holds two look-up tables indicating the two types of the gamma characteristics, reads two values corresponding to the video signal from the two look-up tables, performs alpha blend on the read two values at a ratio depending on the first control signal, and performs the gamma correction on the video signal.

3. The liquid crystal display device according to claim 1, wherein the second video signal generator generates the second video signal by multiplying the video signal by a value obtained by performing inverse gamma correction on the first video signal.

4. The liquid crystal display device according to claim 1, wherein the video signal includes gradation values of three color components, the liquid crystal display device further comprises a maximum value processor that extracts a maximum value from the gradation values of the three color components included in the video signal, and the gamma corrector performs the gamma correction on the maximum value extracted by the maximum value processor.

5. A liquid crystal display device that displays an input video signal, the liquid crystal display device comprising:

a first liquid crystal display panel and a second liquid crystal display panel disposed to be laminated;

a gamma corrector that generates a corrected video signal by performing gamma correction decided depending on a first control signal input from an outside source with respect to the video signal;

a first video signal generator that:

generates a first video signal for the first liquid crystal display panel using the corrected video signal;

performs a stereoscopic vision suppression processing of suppressing stereoscopic vision due to parallax on the corrected video signal with strength depending on a second control signal input from the outside using at least two types of filtering processing; and a second video signal generator that generates a second video signal for the second liquid crystal display panel using the first video signal.

6. The liquid crystal display device according to claim 5, wherein the first video signal generator includes:

a maximum value filter that replaces a gradation value of a pixel indicated by the corrected video signal with a maximum value of gradation values of the pixel and a plurality of pixels adjacent to the pixel; and a minimum value filter that replaces the gradation value of the pixel with a minimum value of the gradation values of the pixel and the plurality of pixels adjacent to the pixel, and the first video signal generator performs the stereoscopic vision suppression processing on the corrected video signal by performing alpha blend of two gradation values obtained using the maximum value filter and the minimum value filter with respect to the corrected video signal at a ratio depending on the second control signal.

7. The liquid crystal display device according to claim 6, wherein the first video signal generator further includes a low-pass filter that generates the first video signal by spatially smoothing the gradation value alpha-blended at the ratio depending on the second control signal.

8. A liquid crystal display device that displays an input video signal, the liquid crystal display device comprising:

a first liquid crystal display panel and a second liquid crystal display panel disposed to be laminated;

a gamma corrector that generates a corrected video signal by performing gamma correction decided depending on a first control signal input from an outside source with respect to the video signal;

a first video signal generator that generates a first video signal for the first liquid crystal display panel using the corrected video signal; and a second video signal generator that generates a second video signal for the second liquid crystal display panel using the first video signal, wherein the video signal includes gradation values of three color components, the liquid crystal display device further comprises a maximum value processor that extracts a maximum value from the gradation values of the three color components included in the video signal, and the gamma corrector performs the gamma correction on the maximum value extracted by the maximum value processor.

* * * * *